US008000646B2

(12) United States Patent
Hirao

(10) Patent No.: US 8,000,646 B2
(45) Date of Patent: Aug. 16, 2011

(54) IMAGE FORMING APPARATUS AND IMAGE FORMING METHOD

(75) Inventor: Naoto Hirao, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 642 days.

(21) Appl. No.: 12/047,360

(22) Filed: Mar. 13, 2008

(65) Prior Publication Data

US 2008/0226999 A1 Sep. 18, 2008

(30) Foreign Application Priority Data

Mar. 14, 2007 (JP) ..... 2007-065096

(51) Int. Cl.
*G03G 15/00* (2006.01)

(52) U.S. Cl. ..... 399/384; 399/385

(58) Field of Classification Search ..... 399/384; 400/616.1

See application file for complete search history.

(56) References Cited

U.S. PATENT DOCUMENTS 4,619,389 A * 10/1986 Isobe ..... 226/79
4,786,353 A * 11/1988 Templeton et al. ..... 156/359
4,839,814 A * 6/1989 Steidel ..... 700/122
5,189,470 A * 2/1993 Matsuda et al. ..... 399/68
5,217,312 A * 6/1993 Ruhe et al. ..... 400/616.1
5,713,674 A * 2/1998 Nakayama et al. ..... 400/55
5,765,460 A * 6/1998 Wathieu ..... 83/37
6,718,150 B2 * 4/2004 Matsuduki ..... 399/194
7,284,486 B2 * 10/2007 Winter et al. ..... 101/485

FOREIGN PATENT DOCUMENTS

JP 40561984 * 10/1993
JP 6-92534 A 4/1994
JP 11240213 * 9/1999

* cited by examiner

*Primary Examiner* — Anthony H. Nguyen
(74) *Attorney, Agent, or Firm* — Sughrue Mion, PLLC

(57) ABSTRACT

An image forming apparatus includes: an image transfer unit that transfers an image to continuous paper provided with a plurality of sprocket holes along a paper length direction on both sides in a paper width direction; an image fixing unit that fixes the image transported to the continuous paper by the image transfer unit; a transport unit that includes a plurality of protruding parts inserted into the sprocket holes on both sides in the paper width direction, that is placed downstream in a paper transport direction from the image fixing unit for moving the protruding parts in the paper transport direction, and that transports the continuous paper; a change unit that changes the spacing between the protruding parts in the paper width direction; and a control unit that controls drive of the change unit.

12 Claims, 8 Drawing Sheets

FIG. 5

| PAPER TYPE | SPACING CHANGE AMOUNT |
|---|---|
| CARDBOARD | $\Delta P1$ |
| ORDINARY PAPER | $\Delta P2$ |
| THIN PAPER | $\Delta P3$ |

*$\Delta P1 < \Delta P2 < \Delta P3$

IMAGE FORMING APPARATUS AND IMAGE FORMING METHOD

CROSS-REFERENCE TO RELATED APPLICATIONS

This application is based on and claims priority under 35 U.S.C. 119 from Japanese Patent Application No. 2007-065096 filed Mar. 14, 2007.

BACKGROUND

Technical Field

This invention relates to an image forming apparatus and an image forming method.

SUMMARY

According to an aspect of the present invention, an image forming apparatus including: an image transfer unit that transfers an image to continuous paper provided with a plurality of sprocket holes along a paper length direction on both sides in a paper width direction; an image fixing unit that fixes the image transported to the continuous paper by the image transfer unit; a transport unit that includes a plurality of protruding parts inserted into the sprocket holes on both sides in the paper width direction, that is placed downstream in a paper transport direction from the image fixing unit for moving the protruding parts in the paper transport direction, and that transports the continuous paper;

a change unit that changes the spacing between the protruding parts in the paper width direction; and a control unit that controls drive of the change unit so that the spacing between the protruding parts in the paper width direction becomes narrower than the spacing between the sprocket holes in the continuous paper before image fixing in the paper width direction during image formation processing of the image transfer unit and the image fixing unit.

BRIEF DESCRIPTION OF THE DRAWINGS

Exemplary embodiment of the present invention will be described in detail based on the following figures, wherein:

FIG. 5 is a drawing to show an example of a control table;

DETAILED DESCRIPTION

Referring now to the accompanying drawings, there is shown an exemplary embodiment of the invention.

Figure 1:
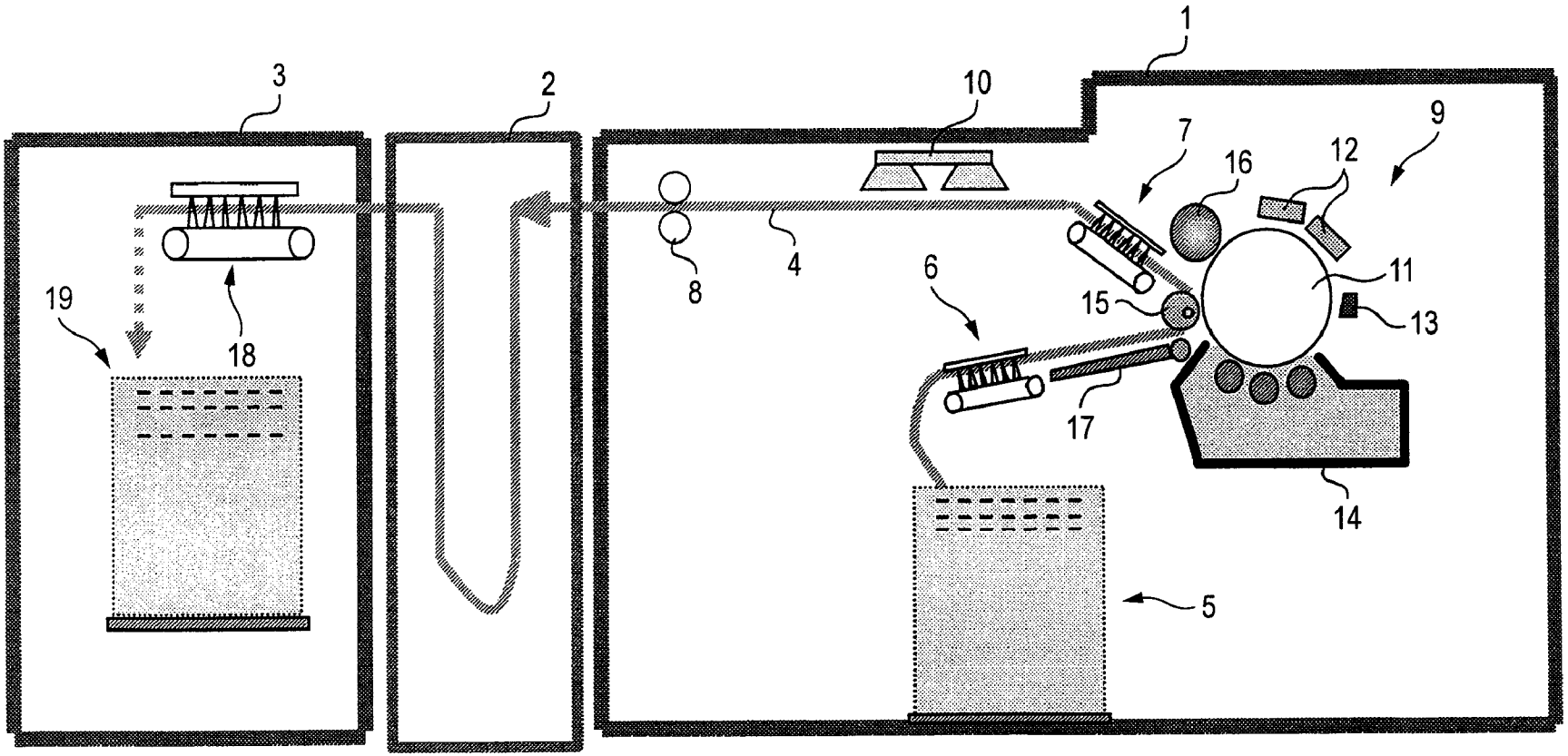
FIG. 1 is a schematic drawing to show a configuration example of an image forming apparatus incorporating the invention.
Figure 2:
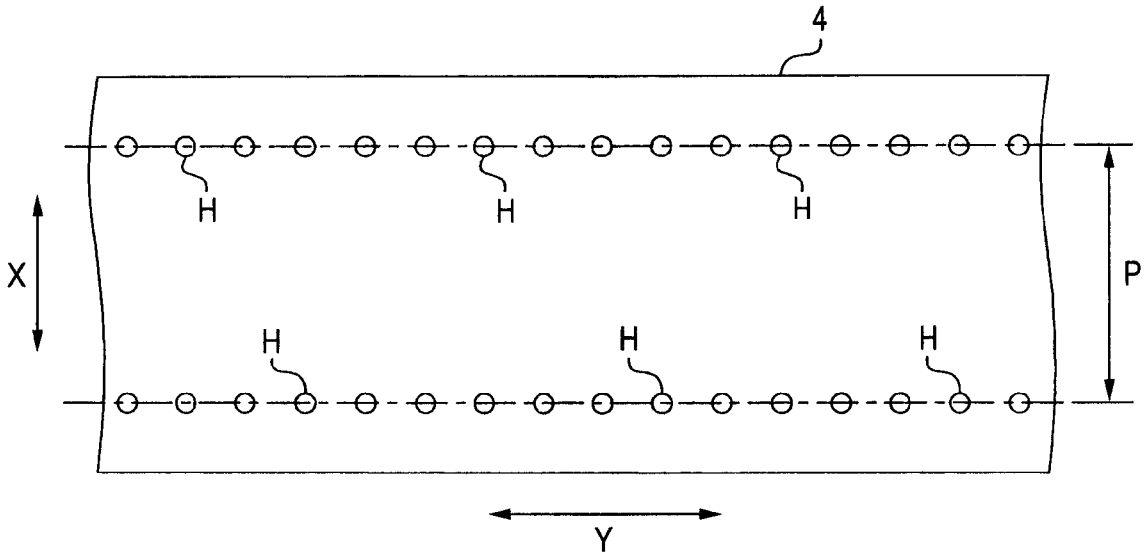
FIG. 2 is a plan view to show a part of continuous paper.

FIG. 1 is a schematic drawing to show a configuration example of an image forming apparatus incorporating the invention. The image forming apparatus shown in the figure is roughly made up of an image printer 1, a buffer 2, and a post-processing unit 3. The image printer 1 prints an image on continuous paper 4 ranging like a belt in accordance with electrophotography. The continuous paper 4 is provided with a plurality of sprocket holes H along a paper length direction Y on both sides in a paper width direction X, as shown in FIG. 2. The sprocket holes H are formed continuously at given spacings in the paper length direction Y. Spacing P between the sprocket holes H in the paper width direction X is set to a dimension smaller than the width of the continuous paper 4.

The image printer 1 includes a hopper section 5 for storing continuous paper 4 before image formation in a stack state, two tractor mechanism sections 6 and 7 for transporting the continuous paper 4 stored in the hopper section 5, a roll pair 8 for drawing the continuous paper 4 into the buffer 2, an image transfer section 9 for transferring a toner image to the continuous paper 4, and an image fixing unit 10 for fixing the toner image onto the continuous paper 4.

The hopper section 5 stores the continuous paper 4 folded like a letter Z. The tractor mechanism section 6 is placed upstream in the paper transport direction from the image transfer section 9, and the tractor mechanism section 7 is placed downstream in the paper transport direction from the image transfer section 9. The roll pair 8 rotates with the continuous paper 4 sandwiched between the rolls, thereby drawing the continuous paper 4 downstream in the paper transport direction.

The image transfer section 9 has a photoconductor drum 11, a charger 12, a laser exposure device 13, a developing device 14, a transfer roll 15, and a drum cleaner 16. The photoconductor drum 11 is rotated clockwise in the figure at given speed. The charger 12 charges the surface of the photoconductor drum 11 at a uniform potential. The laser exposure device 13 scans a laser beam over the surface of the photoconductor drum 11, thereby forming an electrostatic latent image on the surface of the photoconductor drum 11.

The developing device 14 uses toner to develop the electrostatic latent image formed on the surface of the photoconductor drum 11 by the laser exposure device 13. The transfer roll 15 transfers the toner image developed by the developing device 14 to the continuous paper 4. The drum cleaner 16 removes toner remaining on the surface of the photoconductor drum 11 after the transfer with a brush, a blade, etc., for example.

The image fixing unit 10 is implemented as a flash fixing unit for fixing the toner image transferred to the continuous paper 4 by the image transfer section 9 onto the continuous paper 4 by heat energy of flash light, for example. The image fixing unit 10 is placed downstream in the paper transport direction from the tractor mechanism section 7 and upstream in the paper transport direction from the roll pair 8.

A transport guide 17 is provided downstream from the tractor mechanism section 6. It guides the continuous paper 4 transported by the tractor mechanism sections 6 and 7 toward an opposed position between the photoconductor drum 11 and the transfer roll 15 (position at which the toner image is transferred to the continuous paper 4).

The buffer 2 transfers the continuous paper 4 from the image printer 1 to the post-processing unit 3 while absorbing the processing speed difference between the image printer 1 and the post-processing unit 3.

Figure 7:
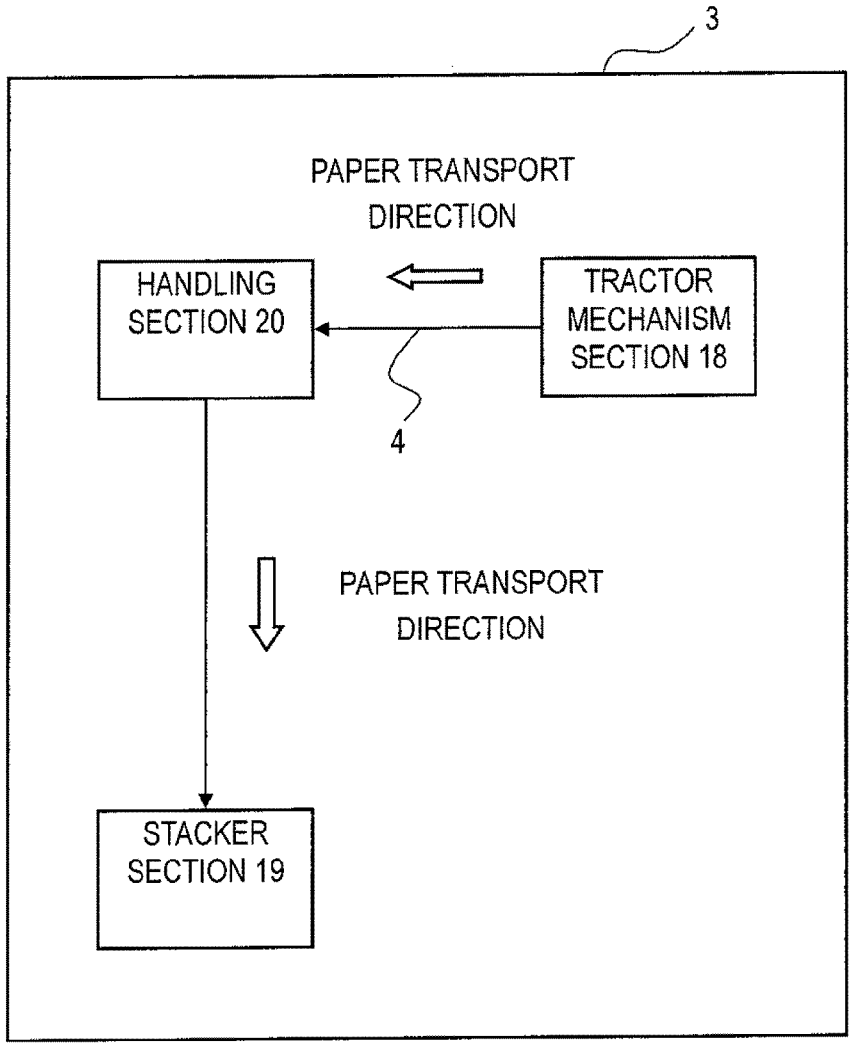
FIG. 7 is a schematic diagram showing portions of the post processing unit.

The post-processing unit 3 performs post-processing for the continuous paper 4 delivered from the buffer 2 with image print (formation) on the continuous paper 4 completed on the image printer 1. The post-processing unit 3 has a tractor mechanism section 18 for transporting the continuous paper 4, a handling section 20 (shown in FIG. 7) for performing predetermined post-processing for the continuous paper 4 transported with the tractor mechanism section 18, for example, cutting the continuous paper 4 to a predetermined length, and a stacker section 19 for storing the paper subjected to post-processing in the handling section 20 in a stack state.

Each of the two tractor mechanism sections 6 and 7 provided in the image printer 1 and the mechanism section 18 provided in the post-processing unit 3 transports the continuous paper 4 according to a pin tractor system. The pin tractor system is a system of transporting continuous paper by providing a plurality of tractor pins on the outer peripheral surface of a tractor belt stretched like a loop shape and running the tractor belt in a peripheral length direction in a state in which the tractor pins are inserted into the sprocket holes of the continuous paper. In the pin tractor system, continuous paper is pressed by a tractor cover with the sprocket holes inserted into the tractor pins, whereby the sprocket holes of the continuous paper are prevented from getting out of the tractor pins.

In the described image forming apparatus, continuous paper 4 drawn out from the hopper section 5 is transported in the paper transport direction by driving the tractor mechanism section 6 and driving the tractor mechanism section 7 in synchronization with driving the tractor mechanism section 6, and a toner image is transferred to the continuous paper 4 by the image transfer section 9 at a midpoint in the transport. The continuous paper 4 to which the toner image is thus transferred is drawn downstream in the paper transport direction by the roll pair 8 and meanwhile the toner image is fixed onto the continuous paper 4 by the image fixing unit 10. At the time, the continuous paper 4 is shrunk by heat applied by the image fixing unit 10.

On the other hand, in the buffer 2, the continuous paper 4 with an image already fixed thereon, delivered from the image printer 1 is transported to the post-processing unit 3. In the post-processing unit 3, the continuous paper 4 delivered from the buffer 2 is transported in the paper transport direction by driving the tractor mechanism section 18 and is also cut to a predetermined length by the handling section 20 (shown in FIG. 7) and then the paper is stored in the stacker section 19.

Figure 3:
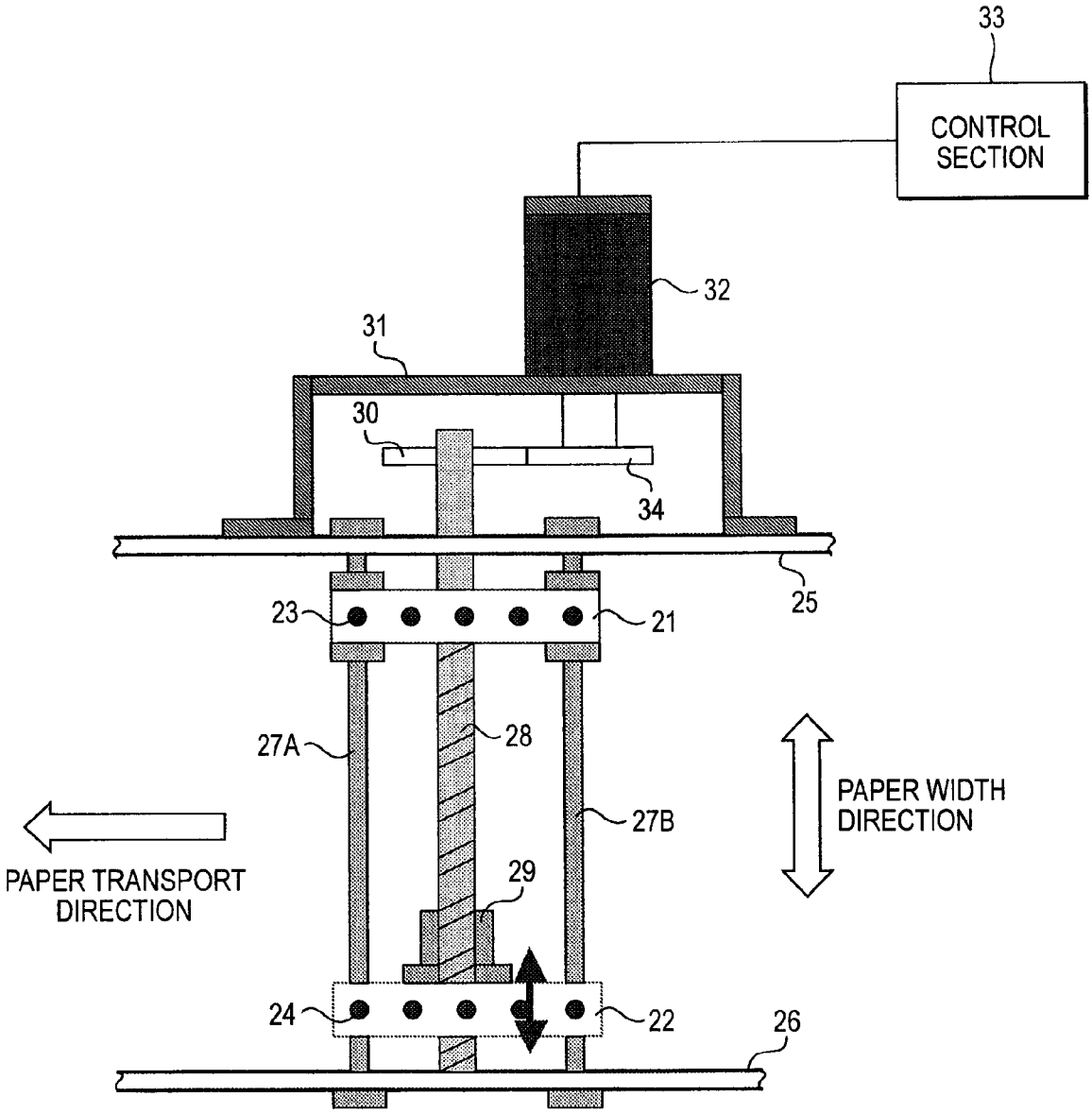
FIG. 3 is a schematic diagram viewing the configuration of a tractor mechanism section included in a post-processing unit as a plane.

FIG. 3 is a schematic diagram viewing the configuration of the tractor mechanism section 18 included in the post-processing unit 3 as a plane. The tractor mechanism section 18 is provided as transport unit. It is provided with two tractor belts 21 and 22. Each of the tractor belts 21 and 22 is stretched like a loop shape between a pair of pulleys (not shown) viewed from the paper width direction orthogonal to the paper transport direction. The pair of pulleys is rotated by a transport motor (not shown) with one pulley as a driving pulley and the other as a driven pulley. A plurality of tractor pins 23 as protruding parts are provided on the outer peripheral portion of the tractor belt 21 and a plurality of tractor pins 24 as protruding parts are also provided on the outer peripheral portion of the tractor belt 22. The spacings of the tractor pins 23 in the paper transport direction and the spacings of the tractor pins 24 in the paper transport direction are set to the same as the spacings of the sprocket holes H in the paper length direction Y shown in FIG. 2.

Two (a pair of) shafts 27A and 28B are placed between frame members 25 and 26 opposed to each other in the paper width direction. The shafts 27A and 28B are placed in parallel with each other in the direction orthogonal to the paper transport direction. A ball screw 28 is placed between the shafts 27A and 28B.

The ball screw 28 has a spiral groove on the outer peripheral portion. It is placed in parallel with the shafts 27A and 28B. The ball screw 28 is supported for rotation using bearing members, etc., in the frame members 25 and 26. A nut member 29 meshing with the spiral groove is attached to the ball screw 28. The nut member 29 is joined to a support member (not shown) provided so as to be movable in the paper width direction with a screw, etc. The support member moves in the paper width direction together with the above-mentioned pair of pulleys (not shown) for supporting the tractor belt 22 like a loop shape. Thus, if the ball screw 28 is rotated, the tractor belt 22 moves in the paper width direction in one piece with the nut member 29 in response to the rotation amount and the rotation direction of the ball screw 28.

One end of the ball screw 28 pierces the frame member 25 and projects to the outside, and a gear 30 is attached to the protruding part. The gear 30 rotates in one piece with the ball screw 28. A motor 32 is attached to the frame member 25 with a motor attachment member 31. It is electrically connected to a control section 33 for controlling drive of the motor 32. For example, if a pulse motor is used as the motor 32, the control section 33 supplies a drive pulse to the motor 32, thereby controlling drive of the motor 32 (rotation amount, rotation direction, etc.,). However, any other motor than the pulse motor, such as a DC servo motor, may be used as the motor 32 and a rotary encode may be attached to the DC servo motor for controlling drive of the motor 32.

A gear 34 is attached to a rotation shaft of the motor 32. It rotates in accordance with drive of the motor 32. The gear 34 meshes with the gear 30. The gears 30 and 34 make up a power transmission mechanism for transmitting the rotation drive force of the motor 32 to the ball screw 28.

In the described tractor mechanism section 18, if the ball screw 28 is rotated by driving the motor 32, the tractor belt 22 moves in the paper width direction together with the nut member 29 along the two shafts 27A and 28B. In contrast, the position of the tractor belt 21 is fixed in the paper width direction. Thus, if the tractor belt 22 moves in the paper width direction, the spacing between the tractor pins 23 and 24 changes in the paper width direction. Thus, the tractor mechanism section 18 includes change unit for changing the spacing between the tractor pins 23 and 24 in the paper width direction.

In the configuration of the tractor mechanism section 18 shown in FIG. 3, one tractor belt 21 is fixed and the other tractor belt 22 is movable in the paper width direction. In contrast, one tractor belt 21 may be movable and the other tractor belt 22 may be fixed.

Both the tractor belts 21 and 22 may be movable by joining a nut member also to one tractor belt 21 in a similar manner to that described above. In this case, if the threading direction of the nut member corresponding to one tractor belt 21 and that of the nut member corresponding to the other tractor belt 22 are opposed to each other and if the two tractor belts 21 and 22 are allowed to move toward or away from each other in the same amount in the paper width direction when the common ball screw 28 with which the nut members mesh is rotated, the center position in the paper width direction does not shift between the tractor pins 23 and 24 even if the spacing between the tractor pins 23 and 24 is changed.

Figure 4:
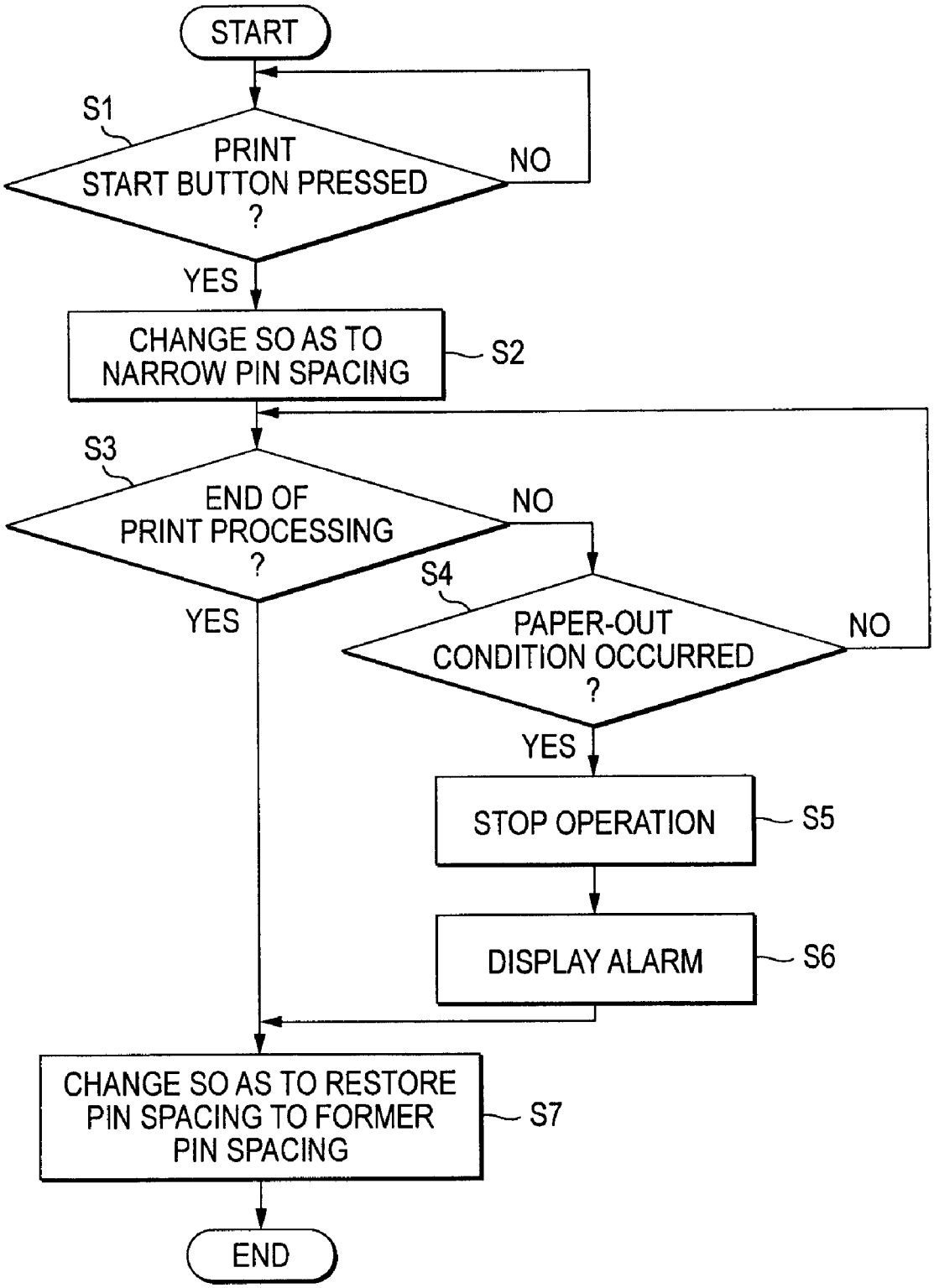
FIG. 4 is a flowchart to show an example of control processing according to an embodiment of the invention.

FIG. 4 is a flowchart to show an example of control processing executed by the control section 33 in the image forming apparatus according to the embodiment of the invention.

To begin with, to place continuous paper 4 in the image forming apparatus, the sprocket holes H made in the continuous paper 4 are fitted into the tractor pins of the tractor mechanism sections 6, 7, and 18 in the paper transport passage from the image printer 1 via the buffer 2 to the post-processing unit 3. In this case, in each of the tractor mechanism sections 6, 7, and 18, the spacing between the tractor pins in the paper width direction is set to the same as the spacing P between the sprocket holes H in the continuous paper 4 (FIG. 2).

After completion of placing the continuous paper 4, if the operator of the image forming apparatus presses a print start button on an operation panel (not shown), then the control section 33 drives the motor 32 provided in the tractor mechanism section 18 in the post-processing unit 3, thereby changing so that the spacing between the tractor pins 23 and 24 in the paper width direction (which will be hereinafter also referred to as "pin spacing") becomes narrower by a given amount than the spacing P between the sprocket holes H in the continuous paper 4 before image fixing in the paper width direction (which will be hereinafter also referred to as "hole spacing") (steps S1 and S2).

The expression "the continuous paper 4 before image fixing" is used to mean the continuous paper 4 before image fixing is performed in the image fixing unit 10 of the image printer 1. Therefore, the continuous paper 4 stacked in the hopper section 5 and the continuous paper 4 drawn out from the hopper section 5 and placed upstream from the image fixing unit 10 correspond each to the continuous paper 4 before image fixing.

In the embodiment of invention, it is assumed that when the control section 33 drives the motor 32 at step S2, it references a control table previously stored in nonvolatile memory, etc., for example. In such a case, the types of continuous paper 4 and the change amounts of the pin spacing are previously associated with each other in the control table referenced by the control section 33.

For example, in the control table, the types of continuous paper 4 are classified according to the thickness of the continuous paper 4 (cardboard, ordinary paper, thin paper) and the change amounts of the pin spacing, $\Delta P1$, $\Delta P2$, and $\Delta P3$, are preset in association with the paper thicknesses, as shown in FIG. 5. As the control section 33 references the control table, if the continuous paper 4 is "cardboard," the motor 32 is driven so as to narrow the spacing between the tractor pins 23 and 24 in the paper width direction by $\Delta P1$; if the continuous paper 4 is "ordinary paper," the motor 32 is driven so as to narrow the spacing between the tractor pins 23 and 24 in the paper width direction by $\Delta P2$; and if the continuous paper 4 is "thin paper," the motor 32 is driven so as to narrow the spacing between the tractor pins 23 and 24 in the paper width direction by $\Delta P3$.

Generally, if a comparison is made between the paper shrink amount caused by thermal fixing when the continuous paper 4 is relatively thick and that when the continuous paper 4 is relatively thin, the paper shrink amount of thin paper becomes larger than that of thick paper. Thus, in the control table, the change amounts of the pin spacing, $\Delta P1$, $\Delta P2$, and $\Delta P3$, are associated with the thicknesses of continuous paper 4 in the relation of $\Delta P1<\Delta P2<\Delta P3$.

Figure 8:
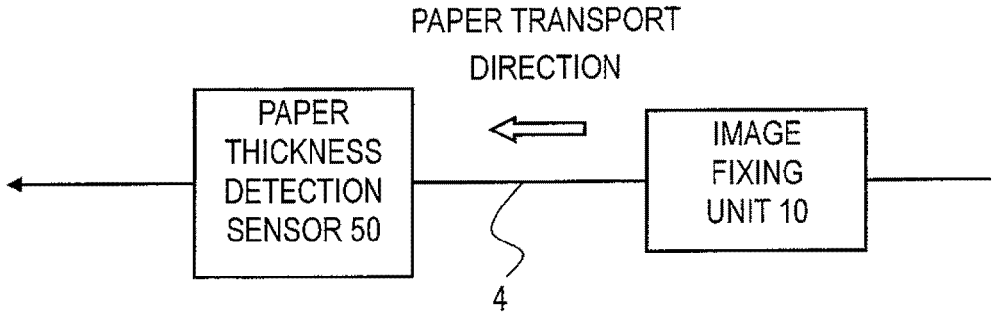
FIG. 8 is a schematic diagram showing the paper thickness detection sensor.

The control section 33 may recognize the thickness of continuous paper 4 based on paper information entered by the operator using the operation panel, etc., or a paper thickness detection sensor 50 (shown in FIG. 8) may be provided downstream in the paper transport direction from the image fixing unit 10 so that the control section 33 recognizes the thickness of continuous paper 4 based on the detection result of the paper thickness detection sensor 50. The paper thickness detection sensor 50 may be implemented as a transmission photosensor for detecting the paper thickness according to the light transmittance difference responsive to the paper thickness, a magnetic angle sensor for detecting the paper thickness according to the lever inclination angle difference responsive to the paper thickness, or the like.

Then, the control section 33 determines whether or not the print processing (image formation processing) in the image printer 1 terminates (step S3). If the control section 33 determines that the print processing in the image printer 1 terminates, it goes to step S7 and drives the motor 32 of the tractor mechanism section 18 under the condition that the pin spacing becomes the same as the hole spacing, thereby restoring the pin spacing to the former pin spacing, and then terminates the processing sequence.

In contrast, if the control section 33 does not determine that the print processing in the image printer 1 terminates, it goes to step S4 and checks whether or not a paper-out condition occurs. If a paper-out condition does not occur, the control section 33 returns to step S3. If a paper-out condition occurs before the print processing terminates, the control section 33 stops the whole processing operation of the image forming apparatus (step 5) and displays an alarm to inform the operator that a paper-out condition has occurred (step S6). Then, the control section 33 goes to step S7 and drives the motor 32 of the tractor mechanism section 18 under the condition that the pin spacing becomes the same as the hole spacing, thereby restoring the pin spacing to the former pin spacing.

Figure 6:
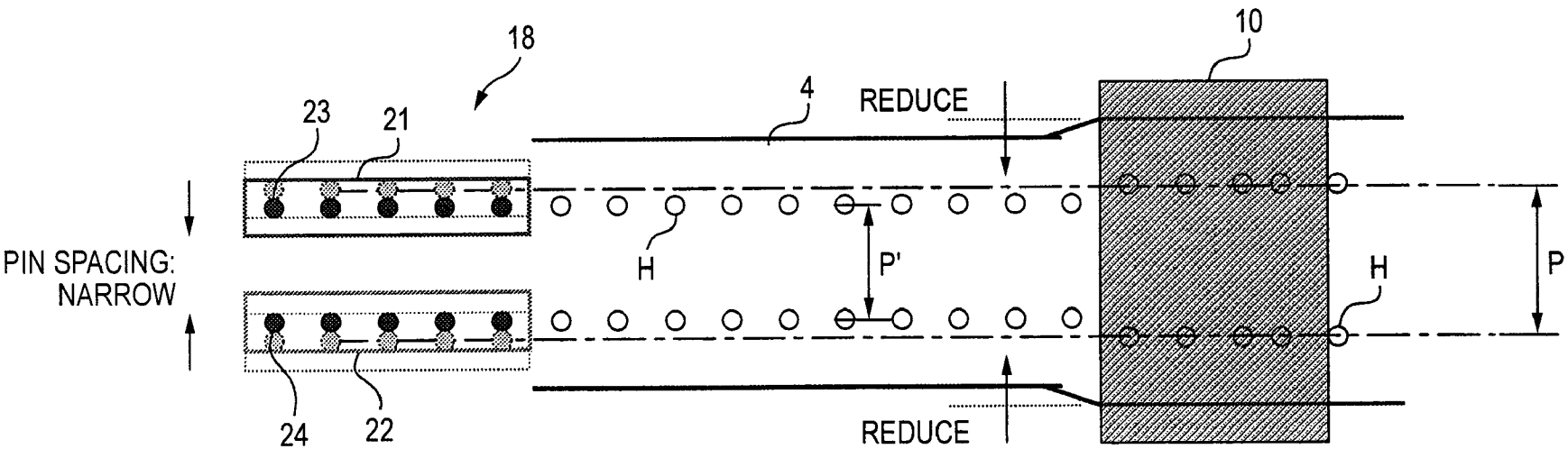
FIG. 6 is a developed plan view to show the positional relationship between sprocket holes in continuous paper and tractor pins.

The control processing as described above is applied, whereby when the toner image transferred to the continuous paper 4 in the image transfer section 9 is thermally fixed in the image fixing unit 10, if the hole spacing in the continuous paper 4 after the image fixing becomes narrow from P to P' as compared with that in the continuous paper 4 before the image fixing as shown in FIG. 6 because of the effect of shrink of the continuous paper 4 caused by the thermal fixing, change is made so as to narrow the pin spacing of the tractor mechanism section 18 accordingly, whereby the shift between the hole spacing in the continuous paper 4 and the pin spacing lessens as compared with the case where the pin spacing is not changed. Thus, the tractor pins 23 and 24 of the tractor mechanism section 18 become hard to get out of the sprocket holes H of the continuous paper 4 in the post-processing unit 3.

In the embodiment described above, the types of continuous paper 4 are classified according to the paper thickness; in addition, the types of continuous paper 4 may be classified according to the paper quality (woodfree paper, wood containing paper, etc.,), for example.

The operator may use the operation panel, etc., to enter the correspondence between the types of continuous paper 4 and the change amounts of the pin spacing in the control table referenced by the control section 33.

The image fixing unit is not limited to the image fixing unit of flash fixing type and may be an image fixing unit using a heat roll. The invention is applied to an electrophotographic image forming apparatus having transport unit of pin tractor system downstream in the paper transport direction from the image fixing unit.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

an image transfer unit that transfers an image to continuous paper provided with a plurality of sprocket holes along a paper length direction on both sides in a paper width direction;

an image fixing unit that fixes the image transported to the continuous paper by the image transfer unit;

a transport unit that includes a plurality of protruding parts inserted into the sprocket holes on both sides in the paper width direction, that is placed downstream in a paper transport direction from the image fixing unit for moving the protruding parts in the paper transport direction, and that transports the continuous paper;

a change unit that changes the spacing between the protruding parts in the paper width direction; and a control unit that controls drive of the change unit so that the spacing between the protruding parts in the paper width direction becomes narrower than the spacing between the sprocket holes in the continuous paper before image fixing in the paper width direction during image formation processing of the image transfer unit and the image fixing unit, wherein the control unit sets automatically a change amount for changing the spacing between the protruding parts in the paper width direction in response to the type of the continuous paper.

2. The image forming apparatus as claimed in claim 1, wherein the control unit sets the change amount for changing the spacing between the protruding parts in the paper width direction in response to a user's input operation.

3. The image forming apparatus as claimed in claim 1, further comprising:

a post-processing unit that includes a handling unit cutting the continuous paper.

4. The image forming apparatus as claimed in claim 1, further comprising:

a paper thickness detection unit that detects a thickness of the continuous paper, wherein the control unit recognizes the thickness of the continuous paper based on detection result of the paper thickness detection unit.

5. The image forming apparatus as claimed in claim 1, wherein the image fixing unit uses a flash fixing technique.

6. An image forming method comprising:

transferring an image to continuous paper provided with a plurality of sprocket holes along a paper length direction on both sides in a paper width direction;

fixing the image transported to the continuous paper;

transporting the continuous paper by inserting a plurality of protruding parts into the sprocket holes and moving the plurality of protruding parts;

changing a spacing between the protruding parts in the paper width direction; and controlling drive of the change unit so that the spacing between the protruding parts in the paper width direction becomes narrower than a spacing between the sprocket holes in the continuous paper before image fixing in the paper width direction during image formation processing, wherein a change amount for changing the spacing between the protruding parts in the paper width direction is set automatically in response to the type of the continuous paper.

7. The image forming apparatus as claimed in claim 1, wherein the image forming apparatus obtains the type of the transported continuous paper, and wherein the control unit sets automatically the change amount for changing the spacing between the protruding parts in the paper width direction using the obtained type of the continuous paper.

8. The image forming method as claimed in claim 6 further comprising:

obtaining the type of the transported continuous paper, wherein the change amount for changing the spacing between the protruding parts in the paper width direction is set automatically using the obtained type of the continuous paper.

9. The image forming apparatus as claimed in claim 7, wherein the type of the continuous paper is classified according to at least one of a thickness of the continuous paper and a paper quality.

10. The image forming method as claimed in claim 8, wherein the type of the continuous paper is classified according to at least one of a thickness of the continuous paper and a paper quality.

11. The image forming apparatus as claimed in claim 7, wherein the image forming apparatus stores a control table which comprises a plurality of types of continuous paper in association with a change amount for changing the spacing between the protruding parts in the paper width direction for each of the respective types, and wherein the control unit sets automatically the change amount for changing the spacing between the protruding parts in the paper width direction by retrieving the change amount associated with the obtained type of the continuous paper from the control table.

12. The image forming method as claimed in claim 8 further comprising:

storing a control table which comprises a plurality of types of continuous paper in association with a change amount for changing the spacing between the protruding parts in the paper width direction for each of the respective types, wherein the change amount for changing the spacing between the protruding parts in the paper width direction is automatically set by retrieving the change amount associated with the obtained type of the continuous paper from the control table.

* * * * *